US009691311B1

(12) United States Patent
Farias

(10) Patent No.: US 9,691,311 B1
(45) Date of Patent: Jun. 27, 2017

(54) BANNER STAND ASSEMBLY

(71) Applicant: Ricardo Farias, Tampa, FL (US)

(72) Inventor: Ricardo Farias, Tampa, FL (US)

( * ) Notice: Subject to any disclaimer, the term of this patent is extended or adjusted under 35 U.S.C. 154(b) by 0 days.

(21) Appl. No.: 15/451,508

(22) Filed: Mar. 7, 2017

Related U.S. Application Data

(60) Provisional application No. 62/304,552, filed on Mar. 7, 2016.

(51) Int. Cl.
*G09F 17/00* (2006.01)
*G09F 15/00* (2006.01)

(52) U.S. Cl.
CPC ..... *G09F 17/00* (2013.01); *G09F 15/0025* (2013.01); *G09F 15/0062* (2013.01)

(58) Field of Classification Search
CPC ... G09F 17/00; G09F 15/0025; G09F 15/0062
See application file for complete search history.

(56) References Cited

U.S. PATENT DOCUMENTS 3,595,509 A * 7/1971 Gilmoure ..... G09F 1/10 248/175
3,868,630 A * 2/1975 Lesondak ..... E01F 13/02 116/63 P
1,700,498 A 10/1987 Perutz et al.
5,347,737 A * 9/1994 Theobald, III ..... G09F 15/0062 248/166
5,551,178 A * 9/1996 Foley ..... G09F 15/0062 248/431
6,038,802 A * 3/2000 Tidwell ..... G09F 15/0025 135/127
6,161,320 A * 12/2000 Peterson ..... G09F 15/0062 160/135
6,370,803 B1 4/2002 Burquest
6,454,227 B1 9/2002 LaMotte
6,988,695 B2 1/2006 Burris
9,633,585 B1 * 4/2017 Hanes ..... G09F 15/0012
2002/0121034 A1 9/2002 Schmitt
2014/0026454 A1 * 1/2014 Weis ..... G09F 15/00 40/610

* cited by examiner

*Primary Examiner* — Gary C Hoge
(74) *Attorney, Agent, or Firm* — Global Intellectual Property Agency, LLC

(57) ABSTRACT

A banner stand assembly. The banner stand assembly includes pair of horizontal members that are insertable through channels in a banner, a plurality of vertical members removably securable therebetween, and a plurality of triangular support members having a flexible central portion slidably and removably secured to the vertical members. The support members are angularly adjustable via movement along the vertical members. The flexible central portion allows the angle of the banner to be adjusted and allows the banner stand assembly to maintain even footing on sloped terrain. The support members are individually height adjustable so that the banner stand assembly can support a banner on varied terrain.

8 Claims, 2 Drawing Sheets

BANNER STAND ASSEMBLY

CROSS REFERENCE TO RELATED APPLICATIONS

This application claims the benefit of U.S. Provisional Application No. 62/304,552 filed on Mar. 7, 2016. The above identified patent application is herein incorporated by reference in its entirety to provide continuity of disclosure.

FIELD OF THE INVENTION

The present invention relates to brackets and stands. More specifically, the present invention provides a banner stand assembly having flexible support members for supporting a banner on varied terrain.

BACKGROUND OF THE INVENTION

Banners are often used for communication, display, or advertising purposes. Banners are preferably large enough to attract attention, and to be readable from a distance. Due to their size, banners must often be attached to large permanent fixtures, which can be a difficult process. Some banners must have custom display stands manufactured for them, which can be time consuming and expensive.

Devices have been disclosed in the known art that relate to banner stands. These include devices that have been patented and published in patent application publications. These devices generally relate to banner stands and display systems, such as U.S. Pat. No. 6,988,695, U.S. Pat. No. 6,370,803, U.S. Pat. No. 4,700,498, U.S. Pat. No. 6,454,227, and U.S. Published Patent Application Number 2002/0121034.

These devices in the known art have several drawbacks. These devices do not provide a mechanism for angular adjustment. Additionally, these devices fail to provide a banner stand assembly having support members with flexible joints for adjusting the angle of the assembly to conform to sloped or otherwise varied terrain.

In light of the devices disclosed in the prior art, it is submitted that the present invention substantially diverges in design elements from the prior art and consequently it is clear that there is a need in the art for an improvement to existing banner stand devices. In this regard the present invention substantially fulfills these needs.

SUMMARY OF THE INVENTION

In view of the foregoing disadvantages inherent in the known types of display stands now present in the prior art, the present invention provides a banner display assembly wherein the same can be utilized for providing convenience for the user when supporting a banner on varied terrain. The banner stand assembly includes a first horizontal member having a plurality of apertures thereon, a second horizontal member having a plurality of apertures thereon, a plurality of vertical members, each of the plurality of vertical members having an upper end and a lower end, and a plurality of support members having an upper end, a lower end, and a flexible central portion. The upper end of each support member is removably secured to the upper end of one of the plurality of vertical members, and the lower end of each support member is removably secured to the lower end of one of the plurality of vertical members. Additionally, the upper end of each vertical member is removably secured to the lower horizontal member.

One object of the present invention is to provide a banner stand assembly that supports a banner having upper and lower channels for receiving the upper and lower horizontal members of the banner stand assembly.

Another object of the present invention is to provide a banner stand assembly that can be sized to fit a particular banner by adding or removing vertical members and support members.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
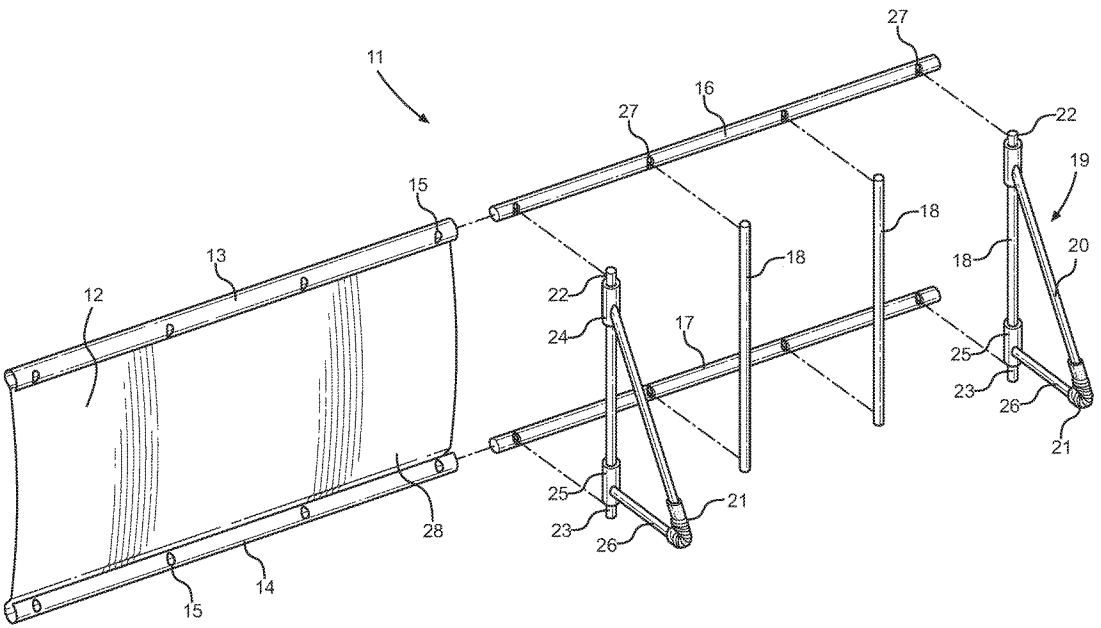
FIG. 1 shows an exploded view of the banner stand assembly.

Reference is made herein to the attached drawings. Like reference numerals are used throughout the drawings to depict like or similar elements of the banner stand assembly. For the purposes of presenting a brief and clear description of the present invention, the preferred embodiment will be discussed as used for supporting a banner on varied terrain. The figures are intended for representative purposes only and should not be considered to be limiting in any respect.

Referring now to FIG. 1, there is shown an exploded view of the banner stand assembly. The banner stand assembly 11 includes a variety of support members that are removably securable to one another in order to support a banner 12 on varied terrain. The banner stand assembly 11 generally comprises an upper horizontal member 16 and a lower horizontal member 17. The upper horizontal member 16 is insertable into an upper channel 13 of the banner 12, and the lower horizontal member 17 is insertable into a lower channel 14 of the banner 12.

The upper and lower horizontal members 16, 17 each comprise a plurality of apertures 27 thereon. Each aperture 27 on the upper horizontal member 16 is sized to receive an upper end 22 of one of a plurality of vertical members 18 therein, and maintain the connection via frictional engagement therewith. In an alternative embodiment, the connection is secured via fasteners. Similarly, each aperture 27 on the lower horizontal member 17 is configured to receive a lower end 23 of one of the plurality of vertical members 18 therein, and maintain the connection via frictional engagement therewith. The upper and lower horizontal members 16, 17 may be of any length depending on the size of the banner 12 to be supported. Similarly, the number of vertical members 18 may vary, with the rigidity of the banner stand assembly 11 increasing as the number of vertical members 18 increases.

The banner stand assembly 11 further comprises one or more support members 19, wherein each support member 19 is removably securable to one of the vertical members 18. The support member 19 includes an upper portion 20 connected to a lower portion 26 via a flexible central portion 21. In the illustrated embodiment, the flexible central portion 21 is a flexible hose joint that joins the upper and lower portions 20, 26 of the support member 19. The hose joint is configured to maintain an angle to which it is bent The support member 19 and the vertical member 18 to which it is secured are configured to maintain a triangular configuration in order to provide ground support for the banner 10.

The lower portion 26 of the support member 19 is removably securable to the lower end 23 of the vertical member 18, and the upper portion 20 of the support member 19 is likewise removably securable to the upper end 22 of the vertical member 18. In the illustrated embodiment, each of the upper and lower portion 20, 26 include connectors thereon that slidably receive the upper and lower ends 22, 23 of the vertical members 18 in frictional engagement therewith.

In the illustrated embodiment, the horizontal member 16, 17, the vertical members 18, and the support members 19 comprise circular cross sections. However, other cross sections may be contemplated, such as triangular or square. Additionally, the horizontal member 16, 17, the vertical members 18, and the support members 19 are composed of a durable and weatherproof material such as PVC, or may be made from metal or another type of plastic.

Figure 2:
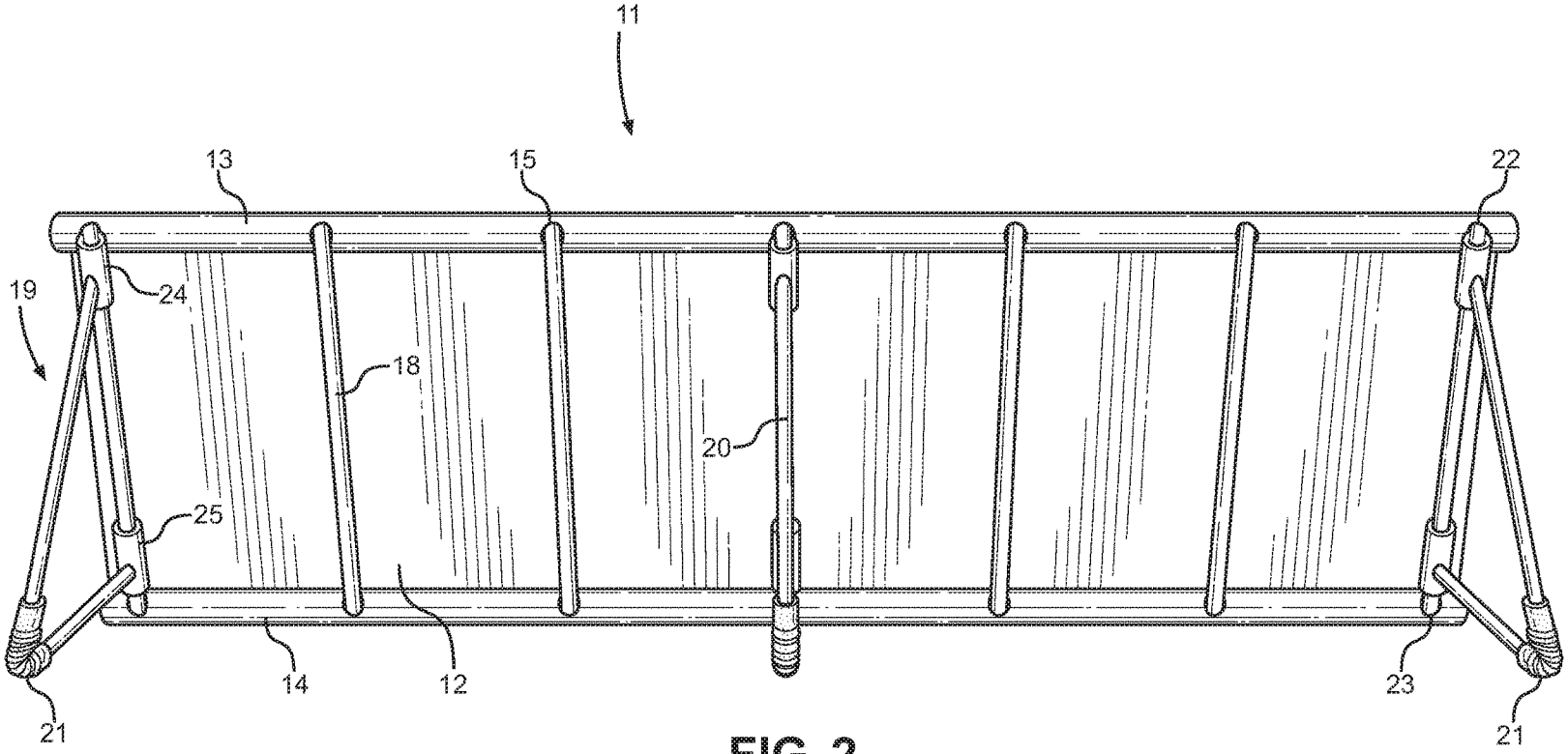
FIG. 2 shows a rear perspective view of the banner stand assembly supporting a banner.

Referring now to FIG. 2, there is shown a rear perspective view of the banner stand assembly supporting a banner. The banner 12 is made substantially rigid by the banner frame assembly 11. The upper and lower horizontal members (not visible) are removably inserted through and upper channel 13 and lower channel 14 of the banner 12. The apertures on the upper and lower horizontal members align with apertures 15 on the upper and lower channels 13, 14 such that the upper and lower ends 22, 23 of the vertical members 18 can be inserted therethrough.

In the illustrated embodiment, three support members 19 are utilized to support the banner 12 on the ground. However, additional support members 19 may be utilized as necessary to effectively support the banner 12. The angle of the support members 19 may be adjusted by sliding the upper and lower connectors 24, 25 to different positions along the vertical member 18, which is facilitated by the flexible central portion 21. In this way, users may adjust the support members 19 to conform to sloping terrain and adjust the angle so the front face of the banner 12 is displayed relative to the supporting terrain. The support members 19 may also be individually adjusted if the banner 12 is situated on varying terrain, so that the banner 12 remains level. For additional support, the support members 19 may be secured to the ground via a stake or similar ground-engaging fastener.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A banner stand assembly, comprising:

a first horizontal member and a second horizontal member each having one or more apertures thereon;

one or more vertical members, each of the one or more vertical members removably connected to the first horizontal member and the second horizontal member at an upper end and a lower end, respectively;

one or more support members, each of the one or more support members comprising an upper end, a lower end, and a flexible central portion;

wherein the upper end of each of the one or more support members is removably secured to the upper end of a vertical member of the one or more vertical members, and the lower end of each of the one or more support member is removably secured to the lower end of a vertical member of the one or more vertical members.

2. The banner stand assembly of claim 1, wherein each of the first horizontal member, the second horizontal member, the one or more vertical members, and the one or more support members comprise circular cross sections.

3. The banner stand assembly of claim 1, wherein the one or more support members is removably secured to the one or more of the vertical members to define a triangular configuration.

4. The banner stand assembly of claim 1, wherein each of the first horizontal member, the second horizontal member, the one or more vertical members, and the one or more support members comprise PVC.

5. The banner stand assembly of claim 1, wherein the upper end and the lower end of each of the one or more support members comprise apertures thereon, wherein aperture of the upper end of each of the one or more support members is configured to receive and frictionally engage the upper end of each of the one or more vertical members, and wherein the aperture of the lower end of each of the one or more support members is configured to receive and frictionally engage the lower end of each of the one or more of vertical members.

6. The banner stand assembly of claim 1, wherein the flexible central portion of the support member comprises a hose joint, wherein the hose joint is configured to maintain a angle to which it is bent.

7. A banner assembly, comprising:

a banner comprising an upper channel, a lower channel, and a length of material spanning therebetween, wherein each of the upper channel and the lower channel comprise a plurality of apertures thereon;

a first horizontal member and a second horizontal member each having a plurality of apertures thereon;

a plurality of vertical members, each of the plurality of vertical members having an upper end and a lower end;

a plurality of support members, each support member comprising an upper end, a lower end, and a flexible central portion;

wherein the upper end of each support member is removably secured to the upper end of one of the plurality of vertical members, and the lower end of each support member is removably secured to the lower end of one of the plurality of vertical members;

wherein the upper end of each vertical member is removably secured to the upper horizontal member, and wherein the lower end of each vertical member is removably secured to the lower horizontal member; and wherein the first horizontal member is removably inserted through the upper channel of the banner, and wherein the second horizontal member is removably inserted through the lower channel of the banner.

8. The banner assembly of claim 7, wherein the plurality of apertures of the first horizontal member are aligned with the plurality of apertures of the upper channel of the banner, and wherein the apertures of the second horizontal member are aligned with the plurality of apertures of the lower channel of the banner.

* * * * *